US008667867B2

(12) United States Patent
Mills et al.

(10) Patent No.: US 8,667,867 B2
(45) Date of Patent: Mar. 11, 2014

(54) POWERED BOTTLE OPENING DEVICE WITH INTEGRATED WRAPPER CUTTER

(75) Inventors: Stephen B. Mills, Atkinson, NH (US); Stevenson Tom, Nashua, NH (US)

(73) Assignee: Brookstone Purchasing, Inc., Merrimack, NH (US)

( * ) Notice: Subject to any disclaimer, the term of this patent is extended or adjusted under 35 U.S.C. 154(b) by 270 days.

(21) Appl. No.: 13/234,505

(22) Filed: Sep. 16, 2011

(65) Prior Publication Data

US 2013/0068070 A1 Mar. 21, 2013

(51) Int. Cl.
*B67B 7/04* (2006.01)
*B67B 7/44* (2006.01)

(52) U.S. Cl.
CPC ..... *B67B 7/04* (2013.01); *B67B 7/0405* (2013.01); *B67B 2007/0458* (2013.01)
USPC ..... 81/3.2; 81/3.09; 30/1.5

(58) Field of Classification Search
USPC ..... 81/3.09, 3.2, 3.33, 3.36, 3.7, 3.29; 30/1.5, 103, 104, 108
See application file for complete search history.

(56) References Cited

U.S. PATENT DOCUMENTS

| | | | | |
|---|---|---|---|---|
| 2,886,994 | A | 5/1959 | Hanson | |
| 4,845,844 | A | 7/1989 | Allen | |
| 5,079,975 | A | 1/1992 | Spencer, Jr. | |
| 5,095,778 | A | 3/1992 | Bocsi | |
| 5,351,579 | A | 10/1994 | Metz | |
| 5,367,923 | A | 11/1994 | Fabbro | |
| 5,372,054 | A | 12/1994 | Federighi, Sr. | |
| 5,503,047 | A | 4/1996 | Brockington | |
| 5,653,023 | A | 8/1997 | Andina | |
| 5,724,869 | A | 3/1998 | May | |
| D404,987 | S | 2/1999 | Larimer | |
| 5,878,497 | A | 3/1999 | Seemann, III | |
| 5,887,305 | A | 3/1999 | Cellini | |
| 5,899,122 | A | 5/1999 | Court | |
| 6,101,899 | A * | 8/2000 | Nikolic | 81/3.2 |
| 6,151,992 | A | 11/2000 | Larimer | |
| 6,196,086 | B1 | 3/2001 | Gort-Barten | |
| 6,321,620 | B1 * | 11/2001 | Fabbro | 81/3.2 |
| D453,453 | S | 2/2002 | Lun | |
| D475,261 | S | 6/2003 | Lee | |
| D477,757 | S | 7/2003 | Yu | |

(Continued)

FOREIGN PATENT DOCUMENTS

HK 03105640.0 A 11/2003

OTHER PUBLICATIONS

Brookstone, Automatic Wine Opener product manual (Sku No. 650846), First Date of Sale Oct. 2010.

(Continued)

*Primary Examiner* — David B Thomas
(74) *Attorney, Agent, or Firm* — Grossman Tucker Perreault & Pfleger, PLLC

(57) ABSTRACT

The present disclosure provides a bottle opening device comprising first and second receptacles to receive at least a portion of a neck of a bottle, with the first receptacle including a wrapper cutting apparatus having at least one cutting element configured to cut a sever in a wrapper on the neck of the bottle, wherein the cutting element is movable towards and away from the wrapper on the neck of the bottle, and the second receptacle including a stopper extractor apparatus configured to remove a stopper from the bottle.

20 Claims, 9 Drawing Sheets

(56) References Cited

U.S. PATENT DOCUMENTS

| | | | |
|---|---|---|---|
| 6,622,595 | B1 | 9/2003 | Federighi |
| D490,286 | S | 5/2004 | Simons |
| 6,739,215 | B2 | 5/2004 | Lozeau |
| 6,752,041 | B2 | 6/2004 | Lee |
| 6,779,213 | B2 | 8/2004 | Yip |
| 6,823,760 | B1 | 11/2004 | Kilduff |
| 6,886,253 | B2 | 5/2005 | Chan |
| 6,978,696 | B2 | 12/2005 | Yu |
| 7,004,050 | B2 | 2/2006 | Wong |
| 7,024,715 | B2 | 4/2006 | Hefti |
| D521,333 | S | 5/2006 | Yu |
| 7,318,362 | B1 | 1/2008 | Hoyer |
| 7,481,134 | B2 | 1/2009 | Goldstein |
| 7,506,445 | B2 | 3/2009 | Buyse |
| 2002/0083590 | A1 | 7/2002 | Scribner et al. |
| 2002/0178867 | A1 | 12/2002 | Lun |
| 2003/0029276 | A1 | 2/2003 | Falcone |
| 2010/0206136 | A1 | 8/2010 | Cheung |

OTHER PUBLICATIONS

Brookstone, Automatic Wine Opener product manual (Sku No. 606368), First Date of Sale Sep. 2008.

Sunbeam Products, Inc., Oster Electric Wine Opener (Model No. 4207/4208) product manual, 2005 (Copyright).

The Sharper Image, Automatic Wine Bottle Opener (Model No. KP-W100) on Amazon, at least as early as Dec. 2009.

Waring, Waring Pro Cordless Wine Opener (Model No. WO50) on Amazon, at least as early as Nov. 2008.

International Search Report and Written Opinion mailed Dec. 20, 2012, received in corresponding PCT Application No. PCT/U2012/055419, 12 pgs.

* cited by examiner

POWERED BOTTLE OPENING DEVICE WITH INTEGRATED WRAPPER CUTTER

TECHNICAL FIELD

The present disclosure is directed to bottle opening devices, and more particularly to a bottle opening device with an integrated wrapper cutter.

BACKGROUND

The opening of a bottle may be closed with a bottle closure to preserve the contents therein. For example, the opening of a wine bottle may be closed with a resilient wine stopper, such as a cork, to preserve the wine therein. Wine and other bottle stoppers may be made of cork from the lightweight elastic outer bark of the cork oak, as well as other materials, such as plastic or rubber, that suitably form a seal with the bottle opening when used as a stopper.

The wine stopper may be positioned and compressed within the opening at the neck of the wine bottle to form a leak proof seal with the walls of the bottle. The wine stopper may not only prevent the wine from escaping from the bottle, but may also protect the wine from the surrounding conditions. For example, the favorable characteristics of wine may be negatively impacted by exposure to the elements of the surrounding environment, such as air. As such, it is advantageous to maintain the seal created between the bottle and the stopper.

The seal created between the bottle and stopper at the bottle opening may also be affected by the surrounding conditions. In particular, cork may be susceptible to drying, which may reduce the resiliency thereof, and cause the seal to fail. To better protect the cork from exposure to surrounding conditions, the neck of the wine bottle, with the cork positioned therein, may be covered with a wrapper. The material for the wrapper may be a metal foil or other material that is durable and helps keep the cork from drying or other damage. The wrapper may also protect the top of the bottle from damage, such as chipping. In addition to its protective function, the wrapper can also be used to add aesthetic appeal to the bottle.

When a bottle stopper, such as a cork, may be used in combination with a protective wrapper, opening the bottle may necessarily be performed in two steps. For example, the wrapper may first be removed, and thereafter the bottle stopper may be extracted from the bottle. A knife or a tool employing a blade may be used to cut the wrapper on the neck of the bottle. Then, a second tool, usually equipped with a spiral-shaped screw, which may be referred to as a corkscrew, may be used to manually capture the bottle stopper and manually pull the bottle stopper from the bottle opening. This technique of opening a bottle, such as a wine bottle, has the disadvantage of requiring two separate tools, such as a knife and a corkscrew.

Furthermore, the tools that may be employed to remove the wrapper and stopper as set forth above may be difficult to use. For example, in order to better function, the wrapper around the neck of the bottle may be relatively thick, and thus, the wrapper may be difficult to cut with a blade such as provided by a knife. In addition, a corkscrew may be difficult to manipulate. The user may have to manually rotate the corkscrew into the cork, involving the difficult task of applying enough force to cause penetration while keeping the corkscrew properly aligned with the center of the cork. Assuming the corkscrew is properly aligned and securely positioned in the cork, the user may then exert additional force to extract the cork, which may require the awkward task of positioning the bottle to gain proper leverage. If the corkscrew is not properly aligned or securely positioned in the cork, or the bottle may not be positioned to gain proper leverage to extract the cork, the result of these efforts may be a failure to successfully extract the cork.

While devices may have been developed to improve either the removal of the wrapper from the neck of the bottle or the extraction of the cork, such improvements still appear to suffer from significant disadvantages. In particular, like the bottle opening technique described above, these improvements may still require the user to utilize multiple devices with a varying range of motions to open a bottle.

SUMMARY

In view of the foregoing, a need exists for a more user-friendly device which integrates functionality for removing the wrapper surrounding the neck of a bottle and for extracting a bottle stopper from the bottle, which may reduce the amount of manual effort and motion required of the user to perform and achieve such tasks. Accordingly, the present disclosure provides a bottle opening device that removes the wrapper and automatically extracts the bottle stopper from the bottle by integrating a wrapper cutter with a simple-to-use bottle stopper extractor to overcome the aforementioned difficulties of the art.

In an exemplary embodiment, the present disclosure provides a bottle opening device comprising first and second receptacles configured to receive a neck of a bottle. The first receptacle may have a first receptacle longitudinal axis and include a wrapper cutting apparatus having at least one cutting element configured to form a sever in a wrapper on the neck of the bottle. The cutting element may be movable towards the first receptacle longitudinal axis when a movable member moves in a first direction along the first receptacle longitudinal axis towards a retracted position in the first receptacle, and the cutting element may be movable away from the first receptacle longitudinal axis when the movable member moves in a second direction along the first receptacle longitudinal axis towards an extended position in the first receptacle, wherein the second direction is opposite the first direction.

The bottle opening device may include a spring arranged to provide a bias force against the movable member in the first receptacle being moved towards the retracted position. The spring may be located in the first receptacle between the movable member that engages a top end of the bottle and a stationary member that receives and operably cooperates with the movable member.

The cutting element may be configured to form a sever in a shape of a ring when the bottle is received in the first receptacle and rotated about the first receptacle longitudinal axis in either a clockwise or a counter-clockwise direction. The cutting element may be at least partially concealed in the first receptacle when the movable member is not in the retracted position. The cutting element may be at least partially concealed in the first receptacle by a cover.

The cutting element may be positionable so as to contact the wrapper when the movable member is moved in the first direction along the first receptacle longitudinal axis towards the retracted position in the first receptacle and positionable so as not to contact the wrapper when the movable member is moved in the second direction (opposite the first direction) along the first receptacle longitudinal axis towards the extended position in the first receptacle.

The cutting element may be carried by the movable member, and more particularly located on a cutter support of the movable member. The cutter support may be configured to move the cutting element. The cutter support may be movable towards the first receptacle longitudinal axis when the movable member is moved in the first direction along the first receptacle longitudinal axis towards the retracted position in the first receptacle and movable away from the first receptacle longitudinal axis when the movable member is moved in the second direction (opposite the first direction) along the first receptacle longitudinal axis towards an extended position in the first receptacle. The cutter support may be movable towards the first receptacle longitudinal axis when the movable member is moved in the first direction along the first receptacle longitudinal axis towards the retracted position in the first receptacle by contact with an abutting structure, wherein for one exemplary embodiment a wedge shaped section of the cutter support comes in contact with the abutting structure in a surrounding wall of the stationary member.

A second receptacle may have a second receptacle longitudinal axis and include a stopper extractor apparatus configured to extract a stopper from the bottle by capturing the stopper on an auger when the auger rotates in a first direction. The stopper extractor apparatus further configured to remove the stopper from the auger and a stopper holder when the auger rotates in a second direction, opposite of the first direction. The bottle opening device may further comprise a power source to provide power to the auger so that the auger may rotate is both clockwise and counter-clockwise directions.

BRIEF DESCRIPTION OF THE DRAWINGS

These and other features and advantages of the present disclosure will be better understood and become more apparent by reading the following detailed description of the present disclosure, when viewed in conjunction with the accompanying drawings wherein.

DETAILED DESCRIPTION

Figure 1:
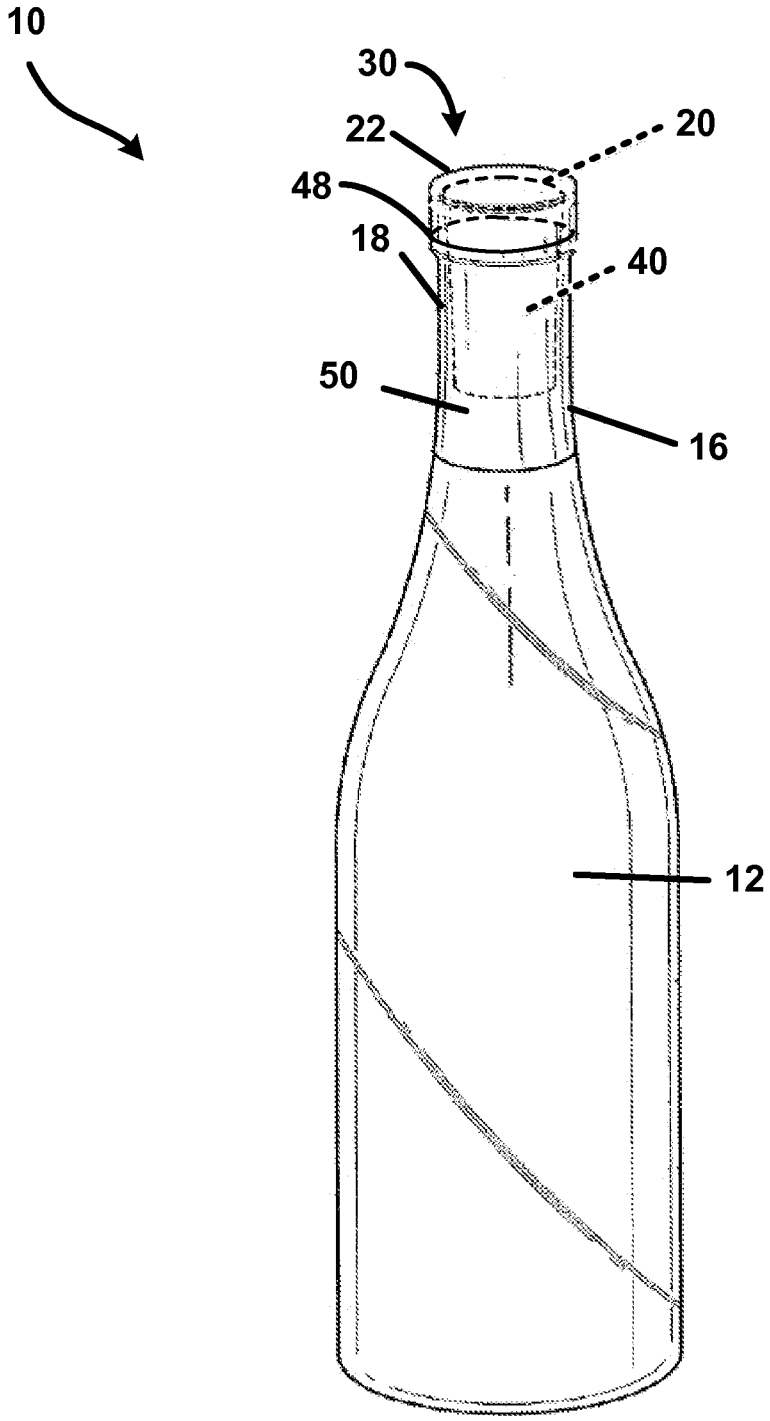
FIG. 1 is an exemplary bottle which may be opened with an exemplary bottle opening device according to the present disclosure.

The present disclosure is not limited in its application to the details of construction and the arrangement of components set forth in the following description or illustrated in the drawings. The invention(s) herein may be capable of other embodiments and of being practiced or being carried out in various ways. Also, the phraseology and terminology used herein is for the purpose of description and should not be regarded as limiting as such may be understood by one of skill in the art.

FIG. 1 illustrates the details of a bottle 10, such as a wine bottle, which may be opened with a bottle opening device 100 of the present disclosure. The bottle 10 has an opening 20 which may be closed by a bottle closure 30 comprising a stopper 40, such as a cork and a wrapper 50. The opening 20 is positioned at a top end 22 of the bottle 10. The bottle 10 may include an elongated, cylindrical neck 16 that extends upwardly from a main body 12 of the bottle 10. The stopper 40 may have a cylindrical or frustoconical shape that is positioned within and forms a seal with the cylindrical walls 18 of the neck 16 of the bottle 10. The stopper 40 may prevent the contents of the bottle 10 from escaping through the opening 20 and/or from being exposed to the conditions of the environment outside the bottle 10. In addition, the opening 20 that is closed by the stopper 40 may be further covered with the wrapper 50 overlying the neck 16 of the bottle 10. The wrapper 50 may be made from a suitable material such as foil, paper, or plastic and may help protect the stopper 40 and the seal it forms with the bottle 10. As discussed herein, the stopper 40 may be inserted and extracted from the opening 20 of the bottle 10.

Figure 2:
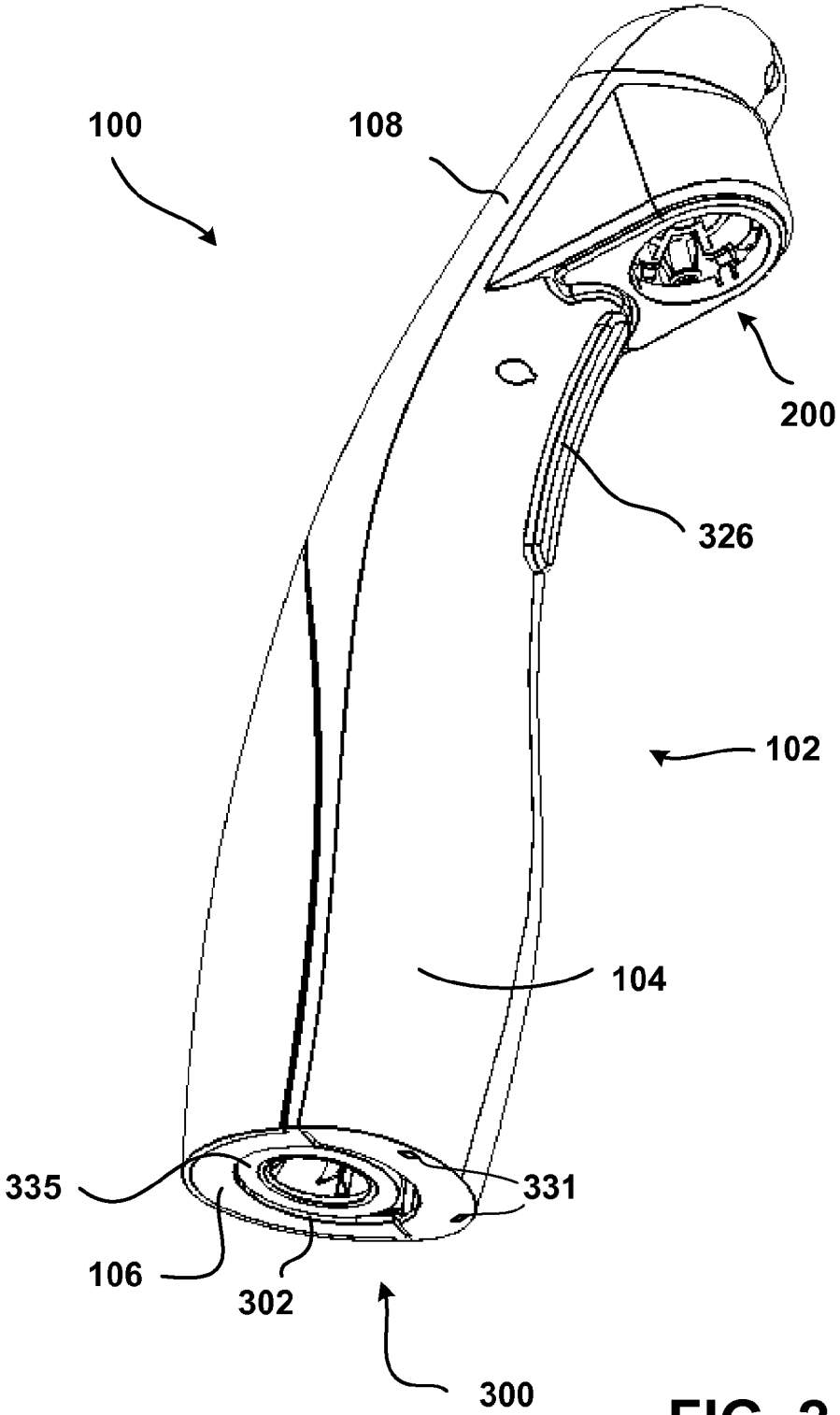
FIG. 2 is a perspective view of an exemplary bottle opening device according to the present disclosure.

Illustrating an exemplary embodiment of the present invention, FIG. 2 shows an electrically powered, and more particularly a rechargeable, bottle opening device 100 which can be used to remove a bottle closure 30 from a bottle, such as the wrapper 50 and stopper 40 from the bottle 10 of FIG. 1. It should be understood that, although the embodiments described herein may be described with respect to opening a bottle, the present disclosure may be used to open other types of containers.

As shown, the bottle opening device 100 may comprise first and second receptacles 200 and 300, respectively, which may each be configured to receive the bottle 10, and more particularly at least portions of the neck 16 thereof. As discussed in greater detail below, the first receptacle 200 may include a wrapper cutting apparatus, and the second receptacle 300 may include a stopper extractor apparatus.

Figure 3:
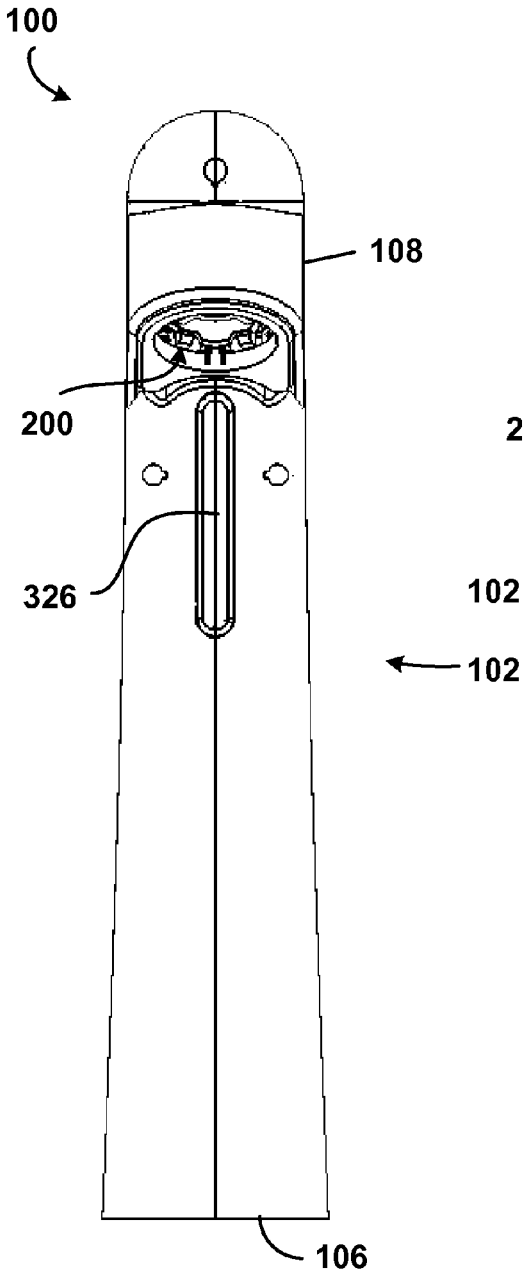
FIG. 3 is a front view of the exemplary bottle opening device of FIG. 2.
Figure 4:
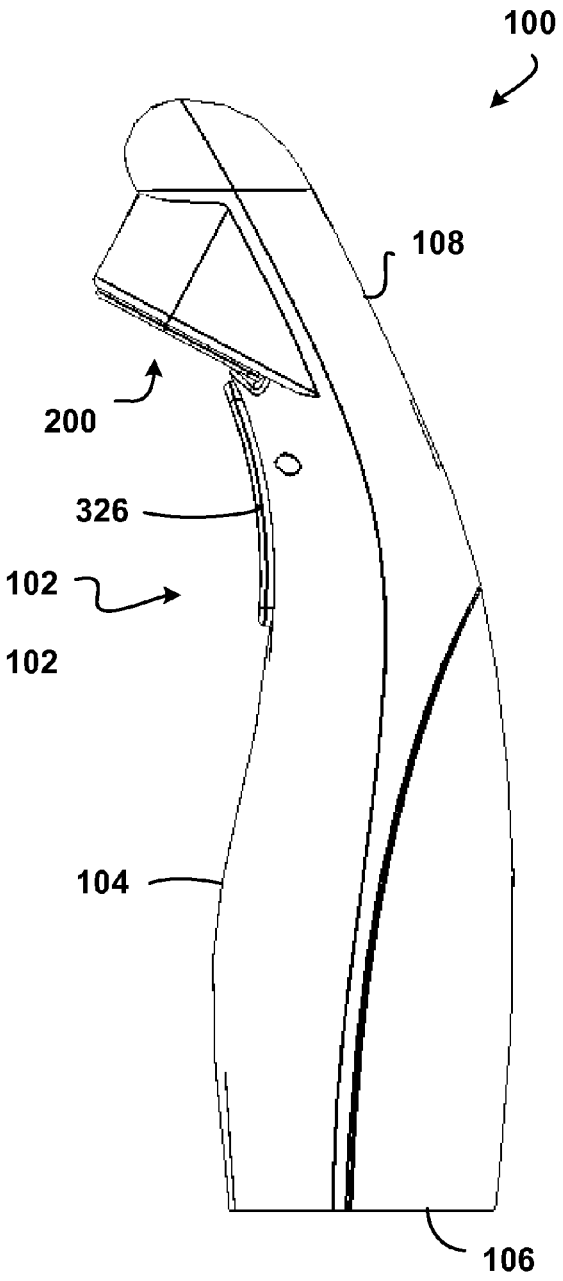
FIG. 4 is a side view of the exemplary bottle opening device of FIG. 2.

As shown in FIGS. 2-4, the bottle opening device 100 may have an elongated, arcuate main housing body 102 comprising a bottom portion 104 and a top portion 108 that may be narrower than the bottom portion 104. Bottom portion 104, which may terminate in a planar bottom surface 106, may be wider than the top portion 108 to help inhibit the device 100 from being easily tipped onto its side. The top portion 108 may be rounded or configured to fit comfortably within the palm of most users' hands.

Figure 5:
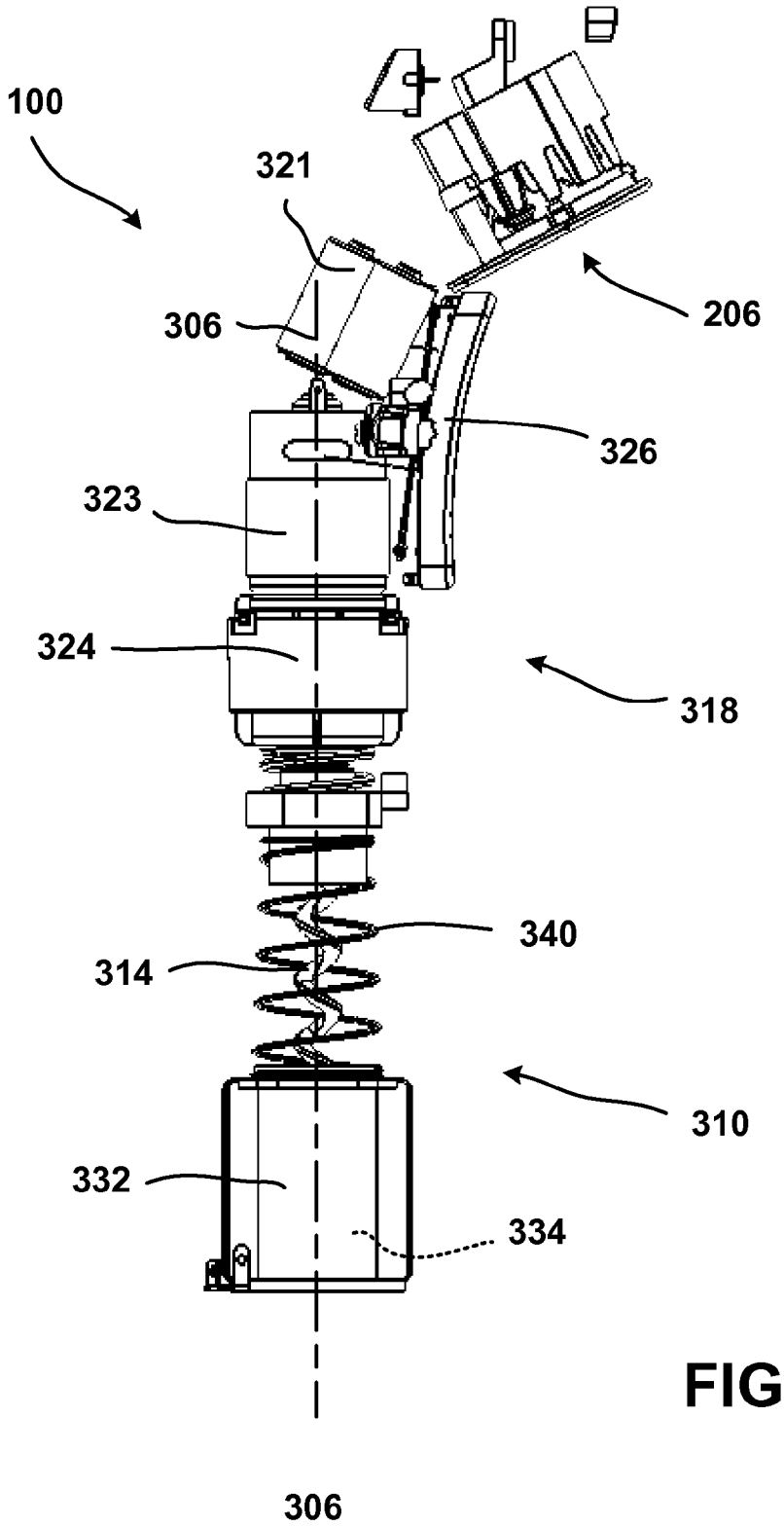
FIG. 5 is a side view of the exemplary bottle opening device of FIG. 2 with the outer housing removed.

Referring now to FIG. 5, the outer housing of bottle opening device 100 has been removed to expose the internal components thereof. As shown in FIG. 5, a wrapper cutting apparatus 206 may be located within the first receptacle 200 shown in FIG. 2. The wrapper cutting apparatus 206 may be particularly configured to sever the wrapper 50 on the neck 16 of the bottle 10 (shown in FIG. 1) in a ring. In the preferred embodiment, the cutting apparatus 206 may be configured to form a sever 48 (shown in FIG. 1) in the wrapper 50 in a shape of a 360 degree ring.

Figure 6:
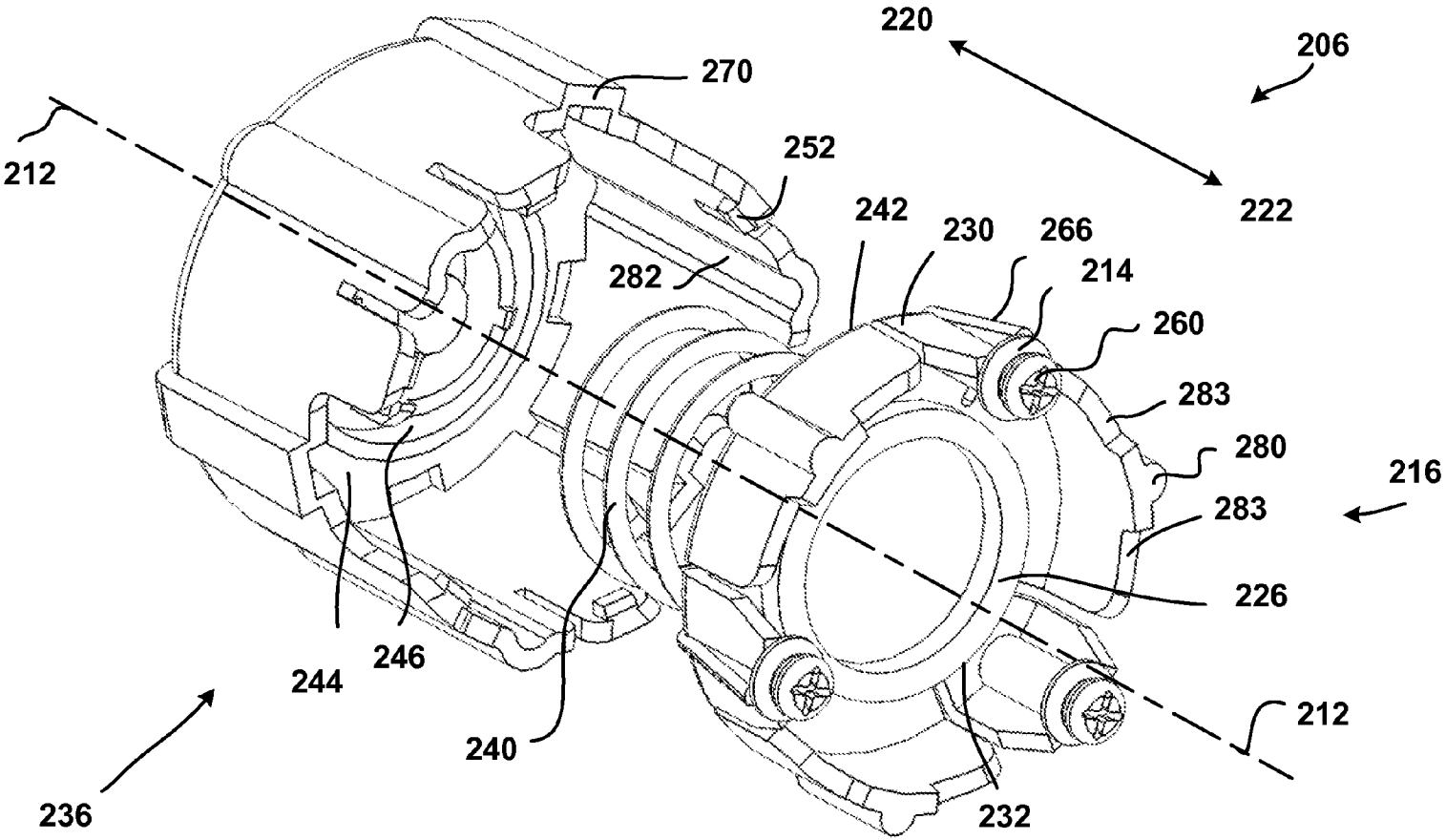
FIG. 6 is an enlarged, exploded perspective view of a wrapper cutting apparatus of the exemplary bottle opening device of FIG. 2.

As shown in FIG. 6, the wrapper cutting apparatus 206 may include at least one cutting element 214 that may be circular or otherwise suitably shaped. The at least one cutting element 214 may be configured to be movable radially towards a first receptacle longitudinal axis 212 when a movable member 216 is moved axially towards a retracted position 220 in the first receptacle 200 and to be movable radially away from the first receptacle longitudinal axis 212 when the movable member 216 is moved axially towards an extended position 222 in the first receptacle 200. The movable member 216 may be made by plastic injection molding or may be made of any suitable polymer, such as, for example polyoxymethylene, polyacetal, polyformaldehyde, polycarbonate, polypropylene, or acrylonitrile-butadiene-styrene.

As shown, a plurality of cutting elements 214 may be spaced around the first receptacle longitudinal axis 212, wherein in the preferred embodiment, the plurality of cutting elements 214 are equally spaced around the periphery of the movable member 216. The at least one cutting element 214 may be operable so as to radially contract into contact with the wrapper 50 on the neck 16 of the bottle 10 when the movable member 216 moves towards or is in the retracted position 220 in the first receptacle 200 by applying sufficient force such as pressing the top end 22 of the bottle 10 against the movable member 216 in the first receptacle 200. At this time, the at least one cutting element 214 may be configured to form sever 48 in a shape of a ring when the bottle 10 is received into the first receptacle 200 and rotated about the first receptacle longitudinal axis 212 in either a clockwise or a counter-clockwise direction. The at least one cutting element 214 may also be operable so as to radially expand out of contact with the wrapper 50 when the movable member 216 moves towards or is in the extended position 222. In the foregoing manner, bottles with different neck sizes may be accommodated for use with the wrapper cutting apparatus 206.

Figure 9:
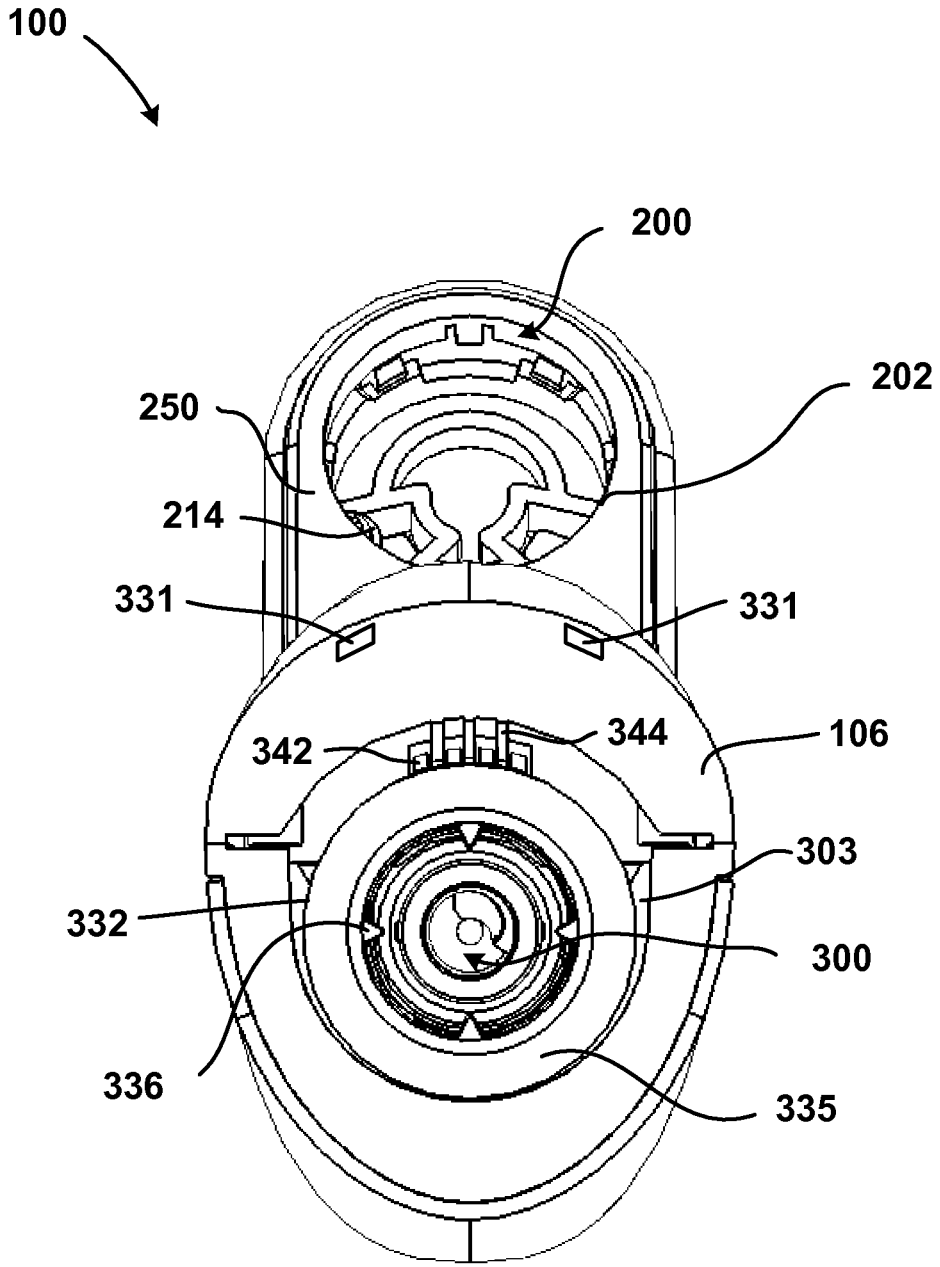
FIG. 9 is a bottom view of the exemplary bottle opening device of FIG. 2.

Turning briefly to FIG. 9, an outer cover 250 may at least partially conceal the at least one cutting element 214 in the first receptacle 200 when the movable member 216 of the first receptacle 200 is in the extended position 222 (shown in FIG. 6). The outer cover 250 may be removable with screws, plastic snap tabs, or other suitable fasteners; whereby, the movable member 216 or cutting elements 214 may be removed from the bottle opening device 100 to service cutting elements 214 which may become dull after repeated use thereof.

Returning to FIG. 6, the movable member 216 may include a bottle engagement section 226, which may be arranged substantially perpendicular to the first receptacle longitudinal axis 212 and configured to engage the top end 22 of the bottle 10. As shown in the preferred embodiment, the bottle engagement section 226 is circular but may be alternatively shaped. The at least one cutting element 214 may be supported on a cutter support 230 located on the movable member 216; whereby, the cutter support 230 may be substantially parallel to the first receptacle longitudinal axis 212 and perpendicular to the bottle engagement section 226. Cutter support 230 may be connected to the bottle engagement section 226 by a hinge 232, wherein in one preferred embodiment, the hinge is an integral hinge (shown in FIG. 6) and another preferred embodiment is a barrel hinge (shown in FIG. 8).

The movable member 216 may be arranged coaxially within a stationary member 236 and configured to slide within the stationary member 236. In its extended position 222, the movable member 216 is extended towards a first opening 202 (shown in FIG. 9) of the first receptacle 200 by a decompression force of a cutter spring 240 arranged to provide a bias (compression) force opposing the movable member 216 being moved towards the retracted position 220. In the present embodiment, the cutter spring 240 is a compression spring but may also be a cantilever or other suitable type of spring. The cutter spring 240 may be located between a rear side 242 of the movable member 216 and a front side 244 of the stationary member 236. The front side 244 of the stationary member 236 may include a containment channel 246 in which to locate and seat the cutter spring 240.

The movable member 216 may travel towards the first opening 202 of the first receptacle 200 until a front edge 283 of the movable member 216 makes contact and engages with at least one snap tab 252 on the stationary member 236, which is preferably cantilevered. The movable member 216 may be removed from the confines of the stationary member 236 by deforming the at least one cantilevered snap tab 252 of the stationary member 236 radially away from the first receptacle longitudinal axis 212. A cutting element 214 may be replaced with a new cutting element 214 as part of a new movable member 216. Alternatively, after removal of the outer cover 250 (shown in FIG. 9), a cutting element 214 may be replaced, by being removed from movable member 216 by the removal of fastener 260, preferably a threaded fastener (e.g. screw) or plastic snap tab, then being replaced with a new cutting element 214 followed by the replacement of the outer cover 250.

When the bottle 10 is placed into the first receptacle 200 with a force sufficient such to overcome the compression force of the cutter spring 240, the movable member 216 will begin to retract into the first receptacle 200. At the same time as the axial displacement is occurring, the at least one cutter support 230 is configured to move with radial displacement towards the first receptacle longitudinal axis 212. More particularly, while the movable member 216 moves towards the retracted position 220 in the first receptacle 200, the at least one cutter support 230 may simultaneously move towards the first receptacle longitudinal axis 212 due to contact between the at least one cutter support 230 and an abutting structure.

Even more particularly, the cutter support 230 may pivot with elastic strain, particularly along hinge 232, which in the present embodiment is an integral hinge, so that the cutter element 214 may simultaneously move towards the first receptacle longitudinal axis 212 due to contact of a wedge shaped section 266 of the cutter support 230 with an abutting structure provided by a surrounding wall 270 of the stationary member 236. In the foregoing manner, as the wedge shaped section 266 extends into greater overlap with the surrounding wall 270, the cutter support 230 may pivot towards the first receptacle longitudinal axis 212 until the cutting member 214 carried thereby makes contact with the wrapper 50 of bottle 10.

As shown in FIG. 6, the wedge shaped section 266 may extend up a side and along a length of the cutter support 230, with the wedge shaped section increasing in size as it approaches the top of the cutter support 230 and farthest away from the bottle engagement section 226. Thus, cutter supports 230 are configured to move the cutting elements 214, which may be supported at the top of the cutter supports 230 and attached thereto by fasteners 260.

Alternatively, when the bottle 10 is being or is removed from the first receptacle 200, the decompression force of the cutter spring 240 forces the movable member 216 towards its extended position 222, and cutter supports 230 may pivot and simultaneously move away from the first receptacle longitudinal axis 212, particularly along the hinge 232 in response to a release of the elastic strain previously induced in hinge 232.

The movable member 216 and the stationary member 236 may further include longitudinally orientated mating portions to inhibit the movable member 216 and the stationary member 236 from rotating relative to one another around the first receptacle longitudinal axis 212. More particularly, the movable member may include a semi-circular key 280 which is configured to mate with a semicircular keyway recess 282 in the stationary member 236.

In an alternative embodiment, the stationary member 236 may be provided as an integral part of housing body 102, such as being molded therewith as a single piece (unitary/monolithic) plastic molding, which may reduce the number of components of bottle opening device 100. In such instance, it should be understood that all the features of the separate stationary member 236 may be integrated into housing body 102. Also, in another embodiment, the travel of the movable member 216 towards the first opening may be limited by outer cover 250, thus eliminating a need for the snap tabs 252 of the stationary member 236.

Figure 8:
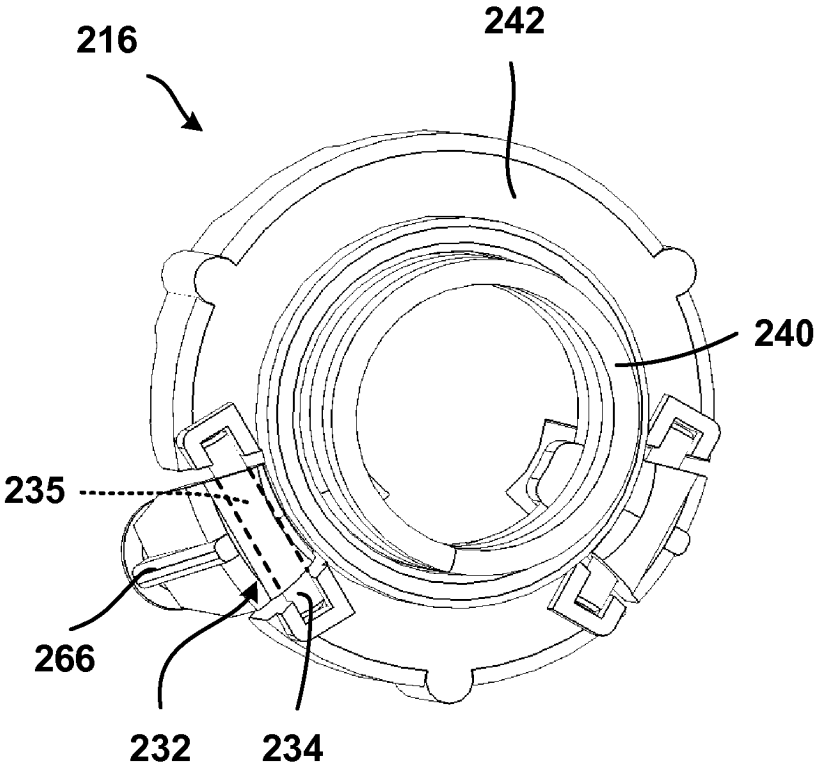
FIG. 8 is an enlarged perspective rear view of an alternative wrapper cutting apparatus of the exemplary bottle opening device of FIG. 2.
Figure 7:
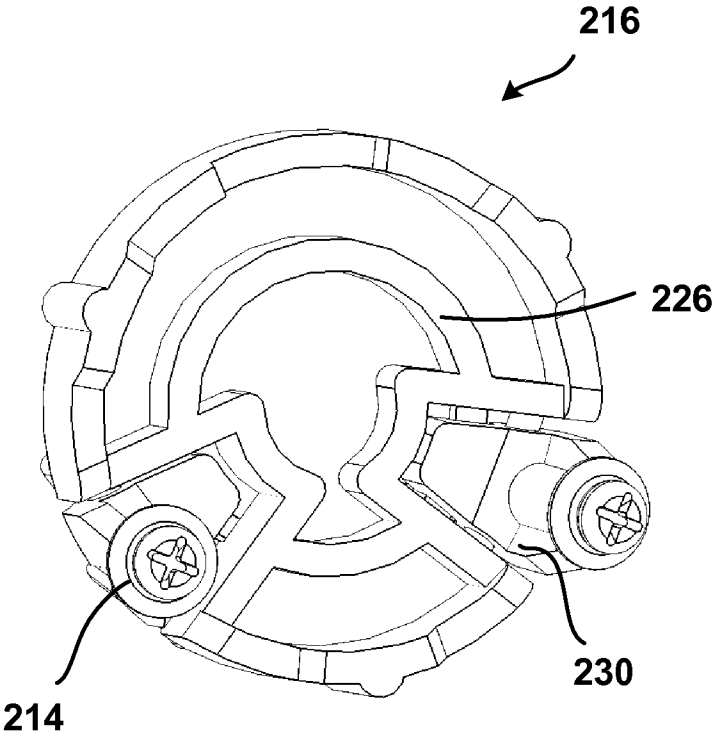
FIG. 7 is an enlarged perspective front view of an alternative wrapper cutting apparatus of the exemplary bottle opening device of FIG. 2.

In another alternative embodiment, as shown in FIGS. 7 and 8, a cutter support 230 and hinge 232 may be separate distinct pieces from the bottle engagement section 226 of the movable member 216. The cutter support 230 may operate similar as in the prior embodiment, however, rather than utilizing a hinge 232 with elastic strain and recovery to facilitate movement of the cutter support 230, a hinge 232 with a pivot pin 234 may be used. As shown in FIGS. 7 and 8, the hinge 232, which in the present embodiment is a barrel hinge, comprises a pivot pin 234, which extends through a barrel 235 formed in the cutter support 230 and is connected at each end thereof to the movable member 216.

Similar to the prior embodiment, simultaneous with a cutter spring 240 being compressed as a movable member 216 is moved towards a retracted position 220, a plurality of cutter supports 230 may move towards a first receptacle longitudinal axis 212 in a first receptacle 200 through contact between a plurality of wedge shaped sections 266 on the cutter supports 230 and abutting structures provided by a surrounding wall 270 of a stationary member 236.

Thereafter, when the bottle 10 is being or is removed from the first receptacle 200, the decompression force of the cutter spring 240 forces the movable member 216 towards its extended position 222, and the cutter supports 230 may simultaneously move away from the first receptacle longitudinal axis 212 by force of the cutter spring 240.

After the wrapper 50 on the bottle 10 has been severed, at least the top of the wrapper 50 may be removed to expose the stopper 40. The bottle 10 may now be transferred to the second receptacle 300 to extract the stopper 40. As shown in FIG. 2, the second receptacle 300 may be accessed through a planar bottom surface 106 of the bottle opening device 100.

Figure 10:
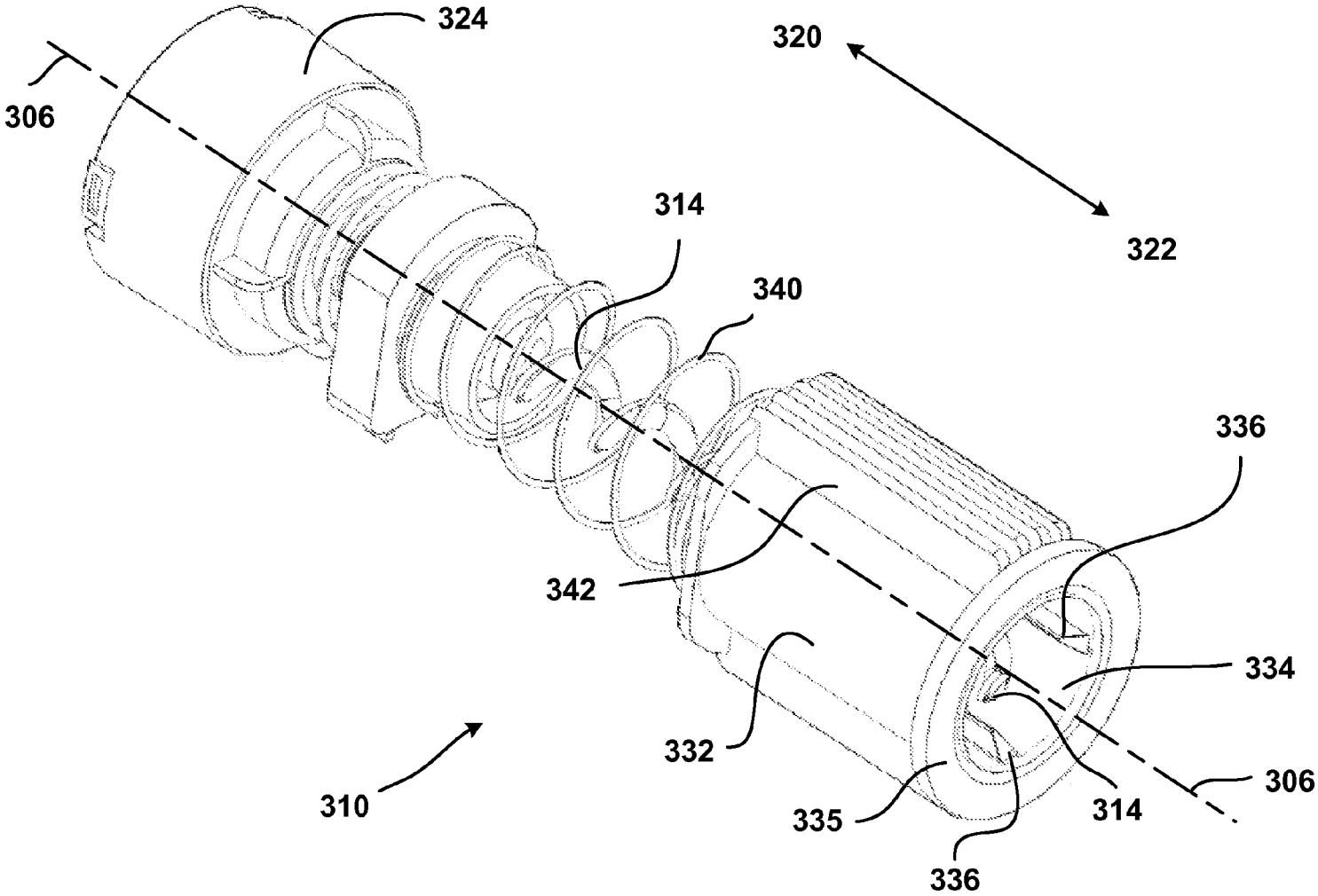
FIG. 10 is an enlarged perspective view of a stopper extractor apparatus of the exemplary bottle opening device of FIG. 2.

Referring now to FIGS. 5, 9, and 10, the stopper extractor apparatus 310 may be located within the second receptacle 300 and configured to extract the stopper 40 from the bottle 10 by capturing the stopper 40 on an auger 314 when the auger 314 is rotated in a first direction.

As shown in FIG. 5, the stopper extractor apparatus 310 may include a power delivery assembly 318 to rotate the auger 314 in a first direction to extract the stopper 40 from the opening 20 of the bottle 10 and in a second direction to remove the stopper 40 from the auger 314. The power delivery apparatus 318 may comprise a power source 321, an electric motor 323, a gear box 324, and a switch 326 to activate and rotate the auger 314 in both clockwise and counter-clockwise directions. Wiring may electrically couple the electric motor 323 to the power source 321 and to the switch 326 for user control of the electric motor 323.

The electric motor 323 may be any type of motor capable of imparting rotation to the auger 314 with sufficient torque to remove the stopper 40 from the bottle 10. More particularly, in one embodiment, the electric motor 323 may be a 3.7 volt reversible DC motor designed for relatively high torque operation while drawing a current below maximum amounts of current deliverable from the power source 321.

In one embodiment, the power source 321 may comprise a set of 3.6 volt DC alkaline, nickel-cadmium (NiCd) or nickel-metal hydride (NiMH) batteries having a battery size designation of 3×AA. However, any power source delivering electric power at the appropriate voltage and current levels may be used. Preferably, the power source 321 is of a rechargeable type.

The gear box 324 may include a gear reduction system coupled to the auger 314. This gear reduction system may decrease speed and increase torque delivered by the electric motor 323. The gears in the gear reduction system may be of a planetary type to reduce the amount of space devoted to gear reduction.

In one embodiment, the switch 326 may comprise a rocker switch configured such that when depressed on one end thereof the auger 314 rotates in the first direction to remove the stopper 40 from the bottle 10, and when depressed on the opposite end thereof the auger 314 rotates in the second direction, being opposite the first direction, to remove the stopper 40 from a stopper holder 332 in the stopper extractor apparatus 310. When the switch 326 is not depressed on either end, the switch 326 will default to a center or off position.

As best shown in FIGS. 5 and 10, the stopper holder 332 of the stopper extractor apparatus 310 may be located within the second receptacle 300 of the bottle opening device 100 and may be slidable within the bottom portion 104 of the bottle opening device 100 (shown in FIG. 2). The stopper holder 332 may include a receiving channel 334 configured to receive the stopper 40 therein, as well as a plurality of ribs 336 oriented towards a second receptacle longitudinal axis 306 in the second receptacle 300 and extending along a length of the receiving channel 334. The ribs 336 may be configured to frictionally engage with the stopper 40. An opener spring 340 may be located between an end of a power delivery apparatus 318 and the stopper holder 332 to provide a decompression force which forces the stopper holder 332 towards an extended position 322 in proximity to the planar bottom surface 106 of the bottle opening device 100 (shown in FIG. 2), as well as to provide a bias force against the stopper holder 332 being moved towards a retracted position 320 along the second receptacle longitudinal axis 306. The opener spring 340 may be a compression, cantilever, or other suitable type of spring. The stopper holder 332 may travel towards the second opening 302 for the second receptacle 300 until a shoulder 335 of the stopper holder 332 makes contact with a shoulder 303 of the second receptacle 300 (shown in FIG. 9).

The stopper extractor apparatus 310 may be operated by a single hand of the user by first placing the top end 22 of the bottle 10 into contact with the shoulder 335 of the stopper holder 332, and thereafter into the second receptacle 300 by a force sufficient to overcome the compression force of the opener spring 340. As a result of the applied force, the stopper holder 332 will begin to retract axially from the extended position 322 towards the retracted position 320 along the second receptacle longitudinal axis 306 and into the second receptacle 300 until a distal end portion of the auger 314 makes contact with the stopper 40. Next, upon activating the auger 314, the neck 16 of the bottle 10 may be drawn further into the second receptacle 300 due to increasing engagement of the auger 314 with the stopper 40, during which time the stopper holder 332 will continue to axially retract from the extended position 322 towards the retracted position 320 along the second receptacle longitudinal axis 306.

Thereafter, when the stopper holder 332 reaches retracted position 320, the stopper 40 may then be drawn from the bottle 10 and into the receiving channel 334 of the stopper holder 332 with continued activation of the auger 314, during which time the stopper 40 is moved along the second receptacle longitudinal axis 306 into retracted position 320. The stopper 40 may then be removed from the stopper holder 332 by reversing the operation of the electric motor 323, via switch 326, so that the auger 314 rotates in a second direction, opposite to the first direction.

It should be understood that the stopper holder 332 need not be fully retracted to retracted position 320 before the stopper 40 may be drawn from the bottle 10. For example, if a bottle has a relatively short neck 16, the main body 12 of the bottle 10 may make contact with the portion of the shoulder 303 defining the opening 302 of the second receptacle 300 before the stopper holder 332 reaches retracted position 320. However, regardless, the interference between the bottle 10 and the portion of the shoulder 303 defining the opening 302 of the second receptacle 300 may now hold the bottle 10 against any further movement towards retracted position 320, thus enabling the auger 314 to now remove the stopper 40.

The exterior of stopper holder 332 and the second receptacle 300 may include a plurality of interlocking members 342 and 344, respectively, (shown in FIG. 9) which extend longitudinally parallel to the second receptacle longitudinal axis 306 and at least a portion of the length of the second receptacle 300. The interlocking members 342 and 344 inhibit the stopper holder 332 from rotating about the second receptacle longitudinal axis 306 particularly when the stopper extractor apparatus 310 is in the process of removing the stopper 40 from the bottle 10. When the stopper 40 is removed from the bottle 10 and the stopper holder 332 has been moved towards or is in the retracted position 320, the interlocking members may disengage allowing the stopper holder 332 to rotate with further rotation of the auger 314. As the bottle 10 is removed from the second receptacle 300, the opener spring 340 may decompress, allowing the interlocking members 342 and 344 to reengage with each other to inhibit rotation of the stopper holder 332 during removal of the stopper 40 from the stopper holder 332 and the auger 314.

Figure 11:
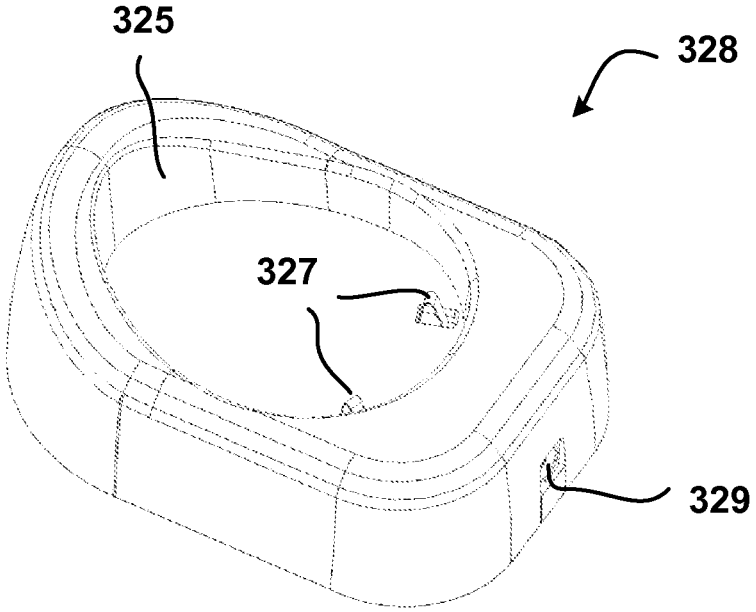
FIG. 11 is a perspective view of a recharging base to be used with the exemplary bottle opening device of FIG. 2.

As best shown in FIGS. 2, 9 and 11, in order to be recharged, the bottle opening device 100 may have at least two opener electrical contacts 331 in a planar bottom surface 106 of the bottle opener device 100 to be used in conjunction with a recharging base 328 configured with a receiving section 325 to capture a bottom portion 104 of the bottle opening device 100. The receiving section 325 of the recharging base 328 may include at least two base electrical contacts 327 to charge the power source 321 in the bottle opening device 100 by mating with the opener electrical contacts 331 and an electrical connector 329 configured to connect with a mating connector and wiring (not shown) which connects the recharging base 328 to 110 volt AC residential voltage. The recharging base 328, the wiring, or an adapter connected to the wiring may include a transformer to transform the AC to DC current.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

What is claimed is:

1. A bottle opening device comprising:

a housing;

first and second receptacles in the housing to receive at least a portion of a neck of a bottle, the first receptacle having a first receptacle longitudinal axis, and the second receptacle having a second receptacle longitudinal axis;

a wrapper cutting apparatus located in the first receptacle, the wrapper cutting apparatus having at least one cutting element configured to form a sever in a wrapper on the neck of the bottle and a movable member that carries the cutting element, and wherein the cutting element moves towards the first receptacle longitudinal axis when the movable member moves in a first direction along the first receptacle longitudinal axis towards a retracted position in the first receptacle and the cutting element moves away from the first receptacle longitudinal axis when the movable member moves in a second direction along the first receptacle longitudinal axis towards an extended position in the first receptacle, wherein the second direction is opposite the first direction;

a stopper extractor apparatus located in the second receptacle, the stopper extractor apparatus configured to remove a stopper from the bottle by capturing the stopper on an auger when the auger is rotated in a first direction; and a power source to provide power to the auger.

2. The device of claim 1 further comprising:

a spring arranged to provide a bias force against the movable member being moved towards the retracted position.

3. The device of claim 2 further comprising:

a stationary member that is capable of receiving and operably cooperates with the movable member, wherein the spring is located between the movable member and the stationary member.

4. The device of claim 1 wherein:

the cutting element is configured to form a sever when the bottle is received in the first receptacle and rotated about the first receptacle longitudinal axis.

5. The device of claim 1 wherein:

the cutting element is at least partially concealed within the first receptacle as the movable member moves toward the extended position.

6. The device of claim 1 wherein:

the cutting element is at least partially concealed within the first receptacle by a cover.

7. The device of claim 1 wherein:

the cutting element is positionable so as to contact the wrapper as the movable member moves towards the retracted position and is positionable so as not to contact the wrapper as the movable member moves towards the extended position.

8. The device of claim 1 wherein:

the cutting element is located on a cutter support on the movable member; and the cutter support is configured to move the cutting element with respect to the first receptacle longitudinal axis.

9. The device of claim 8 wherein:

the cutter support is movable towards the first receptacle longitudinal axis when the movable member moves towards the retracted position in the first receptacle and movable away from the first receptacle longitudinal axis when the movable member moves towards an extended position in the first receptacle.

10. The device of claim 9 wherein:

when the movable member moves towards the retracted position in the first receptacle, the cutter support is moved towards the first receptacle longitudinal axis by contact with an abutting structure in the first receptacle.

11. The device of claim 10 wherein:

the cutter support moves towards the first receptacle longitudinal axis when the movable member moves towards the retracted position in the first receptacle by contact between a wedge shaped section of the cutter support and the abutting structure in the first receptacle.

12. The device of claim 1 wherein:

the cutting element is circular.

13. The device of claim 1 wherein:

the cutting element is replaceable.

14. The device of claim 1 wherein:

the at least one cutting element comprises a plurality of cutting elements spaced around periphery of the movable member.

15. The device of claim 1 further comprising:

an elongated body comprising a top portion and a bottom portion;

the first receptacle being located in a top portion of the elongated body; and the second receptacle being located in a bottom portion of the elongated body.

16. The device of claim 1 wherein:

the stopper extractor apparatus is further configured to remove the stopper from the auger when the auger is rotated in a second direction opposite the first direction.

17. The device of claim 1 wherein:

the power source is a battery.

18. The device of claim 1 further comprising:

an elongated body having a bottom portion, wherein the first and second receptacles are located in the elongated body; and a recharging base including a receiving section and at least two electrical contacts, wherein the electrical contacts of the recharging base are capable of mating with at least two electrical contacts located in the bottom portion of the elongated body when the bottom portion of the elongated body is inserted into the receiving section of the rechargeable base.

19. The device of claim 1 further comprising:

a switch configured to activate the auger.

20. A bottle opening device comprising:

a housing;

first and second receptacles in the housing to receive at least a portion of a neck of a bottle, the first receptacle having a first receptacle longitudinal axis, and the second receptacle having a second receptacle longitudinal axis;

a wrapper cutting apparatus located in the first receptacle, the wrapper cutting apparatus having at least one cutting element configured to form a sever in a wrapper on the neck of the bottle, and wherein the cutting element moves towards the first receptacle longitudinal axis when a movable member moves in a first direction along the first receptacle longitudinal axis towards a retracted position in the first receptacle and the cutting element moves away from the first receptacle longitudinal axis when the movable member moves in a second direction along the first receptacle longitudinal axis towards an extended position in the first receptacle, wherein the second direction is opposite the first direction, wherein the wrapper cutting apparatus further includes a spring arranged to provide a bias force against the movable member being moved towards the retracted position;

a stopper extractor apparatus located in the second receptacle, the stopper extractor apparatus configured to remove a stopper from the bottle by capturing the stopper on an auger when the auger is rotated in a first direction; and a power source to provide power to the auger.

* * * * *